US006108278A

United States Patent [19]

Rochat

[11] Patent Number: 6,108,278

[45] Date of Patent: Aug. 22, 2000

[54] ANNUAL CALENDAR MECHANISM FOR CLOCKWORK MOVEMENT

[75] Inventor: Marco Rochat, Le Brassus, Switzerland

[73] Assignee: Frederic Piguet S.A., Le Brassus, Switzerland

[21] Appl. No.: 09/393,878

[22] Filed: Sep. 10, 1999

[30] Foreign Application Priority Data

Sep. 11, 1998 [CH] Switzerland ..... 1856/98

[51] Int. Cl.[7] ..... G04B 19/24

[52] U.S. Cl. ..... 368/28; 368/37

[58] Field of Search ..... 368/28, 34–38

[56] References Cited

U.S. PATENT DOCUMENTS

| | | | |
|---|---|---|---|
| 3,673,789 | 7/1972 | Tsuzuki et al. . | |
| 3,716,983 | 2/1973 | Tanaka et al. . | |
| 3,827,234 | 8/1974 | Imanishi | 368/37 |
| 4,182,109 | 1/1980 | Teramoto | 368/37 |
| 4,228,644 | 10/1980 | Watanabe et al. | 368/28 |

FOREIGN PATENT DOCUMENTS 756217 1/1997 European Pat. Off. .

*Primary Examiner*—Vit Miska

*Attorney, Agent, or Firm*—Sughrue, Mion, Zinn, Macpeak & Seas, PLLC

[57] ABSTRACT

An annual calendar mechanism including a date-disc provided with a first inner toothing including thirty one teeth, and a date drive wheel and pinion, said wheel and pinion including a finger capable of driving said date-disc through one step once a day, characterized in that the date-disc includes a second inner toothing provided for driving, via a gear train, a month-cam carrying at least five teeth, each of these teeth being arranged to be situated, at the end of the months of less than thirty one days, on the path of the beak of a lever and in that said lever carries a correction drive wheel and pinion fitted with a correction finger co-operating with the first or second toothing at the end of the aforecited months to drive the date-disc through one additional step at the end of said months when the lever pivots following the passage of its beak over a tooth of said cam.

14 Claims, 9 Drawing Sheets

The 30th of a 30 day-month,9:00 p.m

The 30th of a 30 day-month,midnight

The 1st, following a 30 day-month, 2:30 am

The 30th of a 31 day-month,9:00 pm

The 31st of a 31 day-month, 9:00 pm

The 1st, following a 31 day-month, 9:00 pm

ANNUAL CALENDAR MECHANISM FOR CLOCKWORK MOVEMENT

The present invention concerns an annual calendar mechanism for a clockwork movement, i.e. a calendar mechanism allowing the exact day of the month to be displayed by performing only one correction per year of one or two days to set the calendar to the first of March at the end of February.

Annual calendar mechanisms for clockwork movements such as that disclosed in Japanese Patent No. A-39 534/75 are known. According to this document, the mechanism includes a date-disc provided with thirty one inner teeth situated at a first level and on which are marked thirty one figures each corresponding to an indication of the day of the month, these figures appearing successively through a window arranged in a dial. A date-disc drive wheel and pinion, provided with a drive finger, makes one revolution every twenty four hours and is capable of driving the date-disc through one step once a day, via its inner toothing to control the date display.

This mechanism also includes a device used for correcting the date display at the end of each of the months having less than thirty one days. This device includes an intermediate wheel driven in the clockwise direction by a second toothing attached to the date-disc and situated at a second level. A month-star is driven in the anti-clockwise direction by the intermediate wheel and carries a month-cam whose profile is formed of successive teeth and hollows. An articulated lever returned by a spring is controlled by the month-cam for driving the date-disc by acting on a third toothing attached to the date-disc and situated at a third level.

At the end of the months of less than thirty one days, a control beak of the lever enters a hollow of the month-cam so that the lever pivots in the anti-clockwise direction and acts on the date-disc via a drive beak to cause it to advance by one additional step and cause the latter to pass from the thirty first of one month to the first of the following month without a manual correction having to be performed. For this purpose, the drive beak includes at its free end an inclined drive plane intended to push the flank of a tooth of the third toothing of the date-disc in the clockwise direction. More precisely, when the control beak is situated on a tooth, the drive beak rests against the top of the flank of the tooth which it has to push, and as soon as the control beak enters a hollow, the drive plane of the beak is supposed to slide onto the flank of the tooth in question by pushing it to cause the date-disc to advance by one step.

However, a mechanism of this type has numerous drawbacks.

First, this mechanism requires complex and difficult adjustment of the respective slopes of the beak drive plane and the flank of the teeth of the third toothing. And even with fine adjustment, there is still a high risk of the mechanism becoming blocked because of significant friction phenomena due to the direction of the forces which enter into play between this drive plane and the flank when the tooth is pushed.

This mechanism thus requires a significant force to be available on the centre wheel to assure driving of the date-disc, which increases the power consumption of the movement and leads to a reduction of at least 20% in the autonomy of the movement's power supply. This drawback is further amplified to the extent that the available force must be sufficient to overcome the force of three positioning jumper springs, namely the force of the conventional date-disc positioning jumper spring, that of the drive lever jumper spring and that of a positioning jumper spring of the intermediate wheel.

Moreover, the presence of three toothings on the date-disc, distributed across three different levels, increases the mechanism's height space requirement. This constitutes a significant drawback since the current trend is to make increasingly compact movements, and in particular having the smallest thickness possible.

Further, at the end of a month of thirty days, the third toothing must be pushed to the inclined flank of drive beak, which means that the wheel which drives the disc with thirty one teeth must advance by 1/31st of a revolution. This mechanism can thus not be used with a conventional instantaneous or quasi instantaneous calendar device.

The main object of the present invention is thus to overcome the drawbacks of the aforementioned prior art, by providing an annual calendar mechanism having a more reliable design than that of the prior art, of reduced height and which does not affect the autonomy of the movement to which it is fitted.

The invention therefore concerns an annual calendar mechanism for a timepiece including a date-disc provided with a first inner toothing including thirty one teeth and on which are marked thirty one figures each corresponding to an indication of a day of the month, said indications appearing successively through a window arranged in a dial, and a date drive wheel and pinion making one revolution every twenty four hours, said wheel and pinion including a finger capable of driving said date-disc through one step once a day via one of the teeth of the inner toothing to control the date display, this mechanism being characterised in that the date-disc includes a second inner toothing provided for driving, via a gear train, a month-cam carrying at least five teeth corresponding to the months of less than thirty one days, each of these teeth being arranged to be situated, at the end of the months of less than thirty one days, on the path of the beak of a lever and in that said lever carries a correction wheel and pinion fitted with a correction finger capable of co-operating with said second toothing at the end of the aforecited months to drive the date-disc through one additional step at the end of said months when the lever pivots following the passage of its beak over a tooth of the month-cam.

As a result of these features, one obtains a mechanism which operates reliably, which allows the passage from the thirty first of a month of thirty one days to the first of the following month almost instantaneously, and which further has a greatly reduced height space requirement. By way of indication, this passage lasts approximately 2 hours with the mechanism of the invention.

This mechanism does not require the use of a jumper-spring other than that which assures the positioning of the date-disc, so that it does not involve any additional power consumption.

Other features and advantages of the present invention will appear in the following description of a preferred embodiment, given by way of non-limiting example with reference to the annexed drawings, in which.

Figure 1:
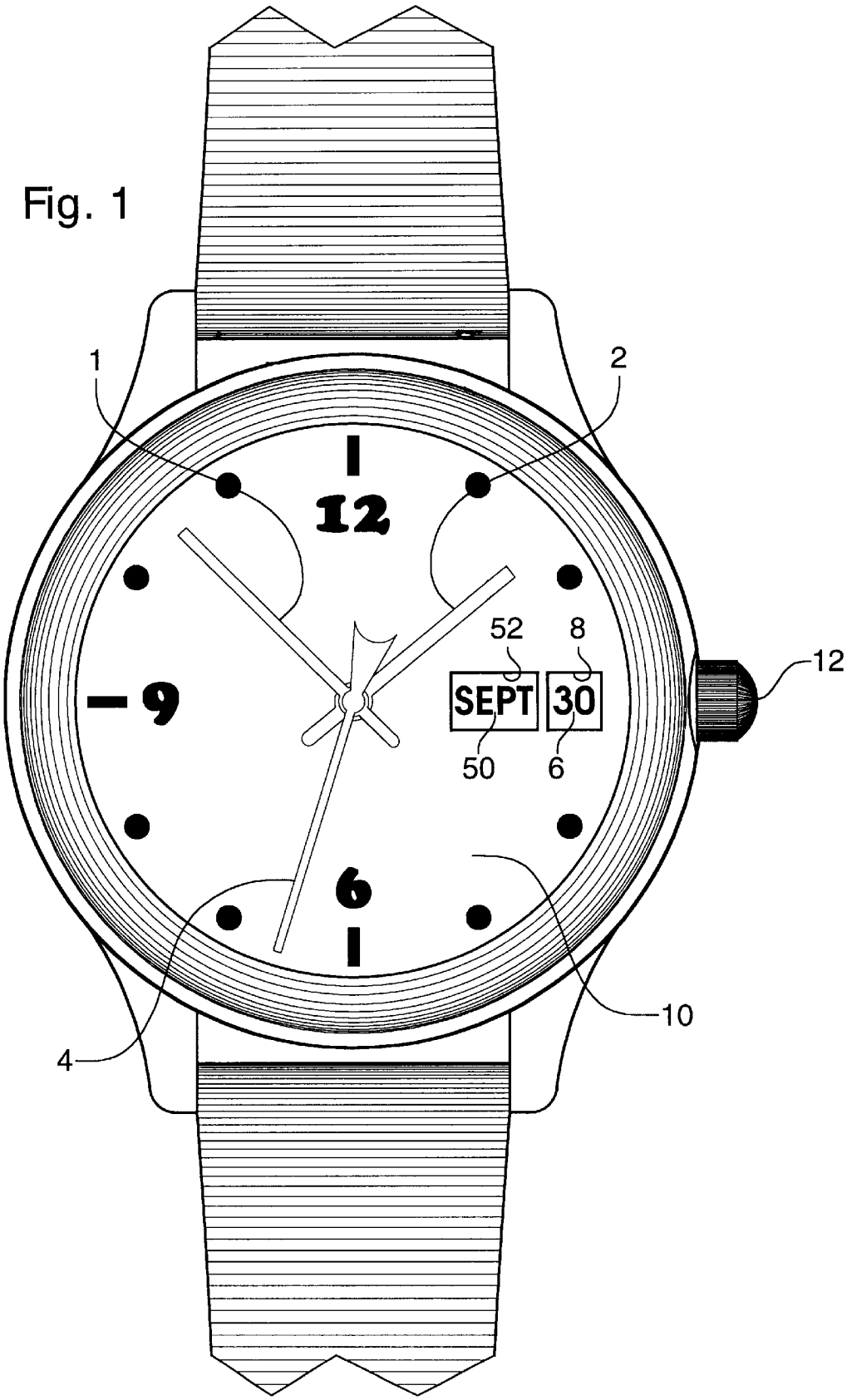
FIG. 1 is a plane view of a watch fitted with an annual calendar mechanism according to the invention.

The plane view of FIG. 1 illustrates an annular calendar watch fitted in particular with hands for the hours 1, minutes 2, seconds 3 and a date indicator in the form of a date 6 appearing through a window 8 arranged in a dial 10. Time setting can be performed by using a crown 12.

Figure 2:
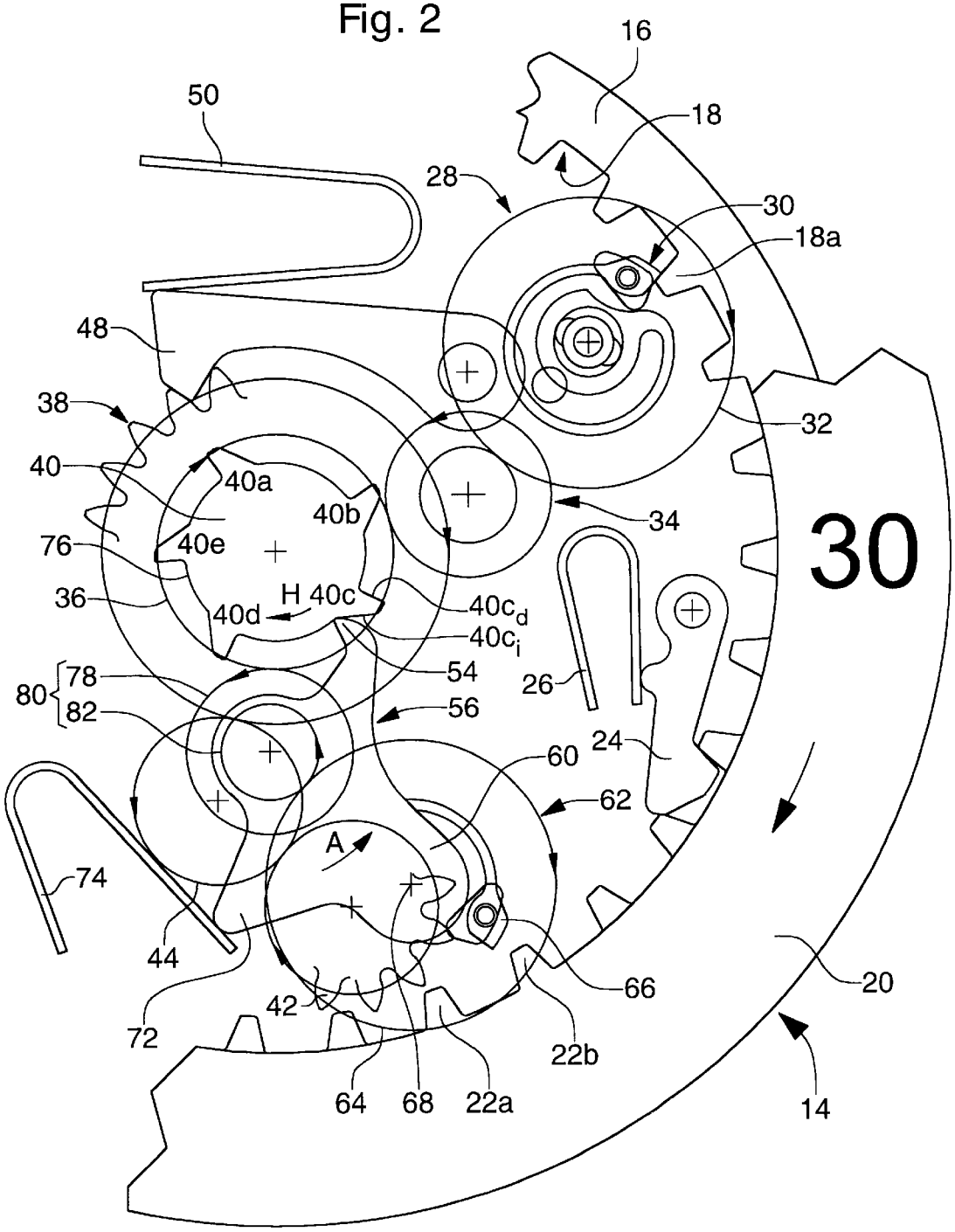
FIG. 2 is a plane view of the annual calendar mechanism fitted to the watch of FIG. 1, this Figure illustrating the position of the gear trains on the 30th of a month of less than thirty one days at 21 hours.
Figure 3:
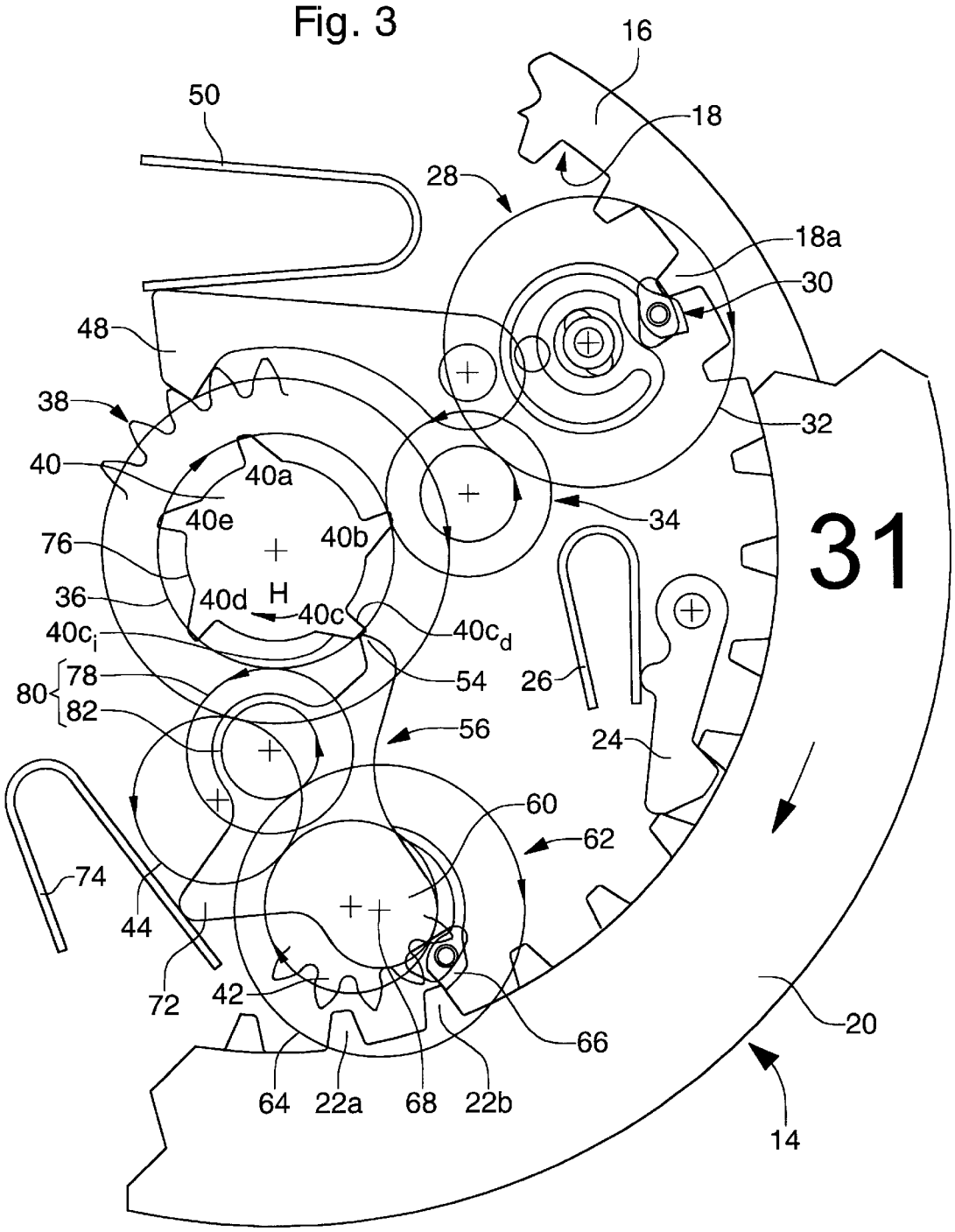
FIGS. 3 and 4 are similar view to those of FIG. 2, the position of the gear trains being shown respectively on the 30th of the same month at midnight and the 1st of the following month at 2.30 hours.
Figure 4:
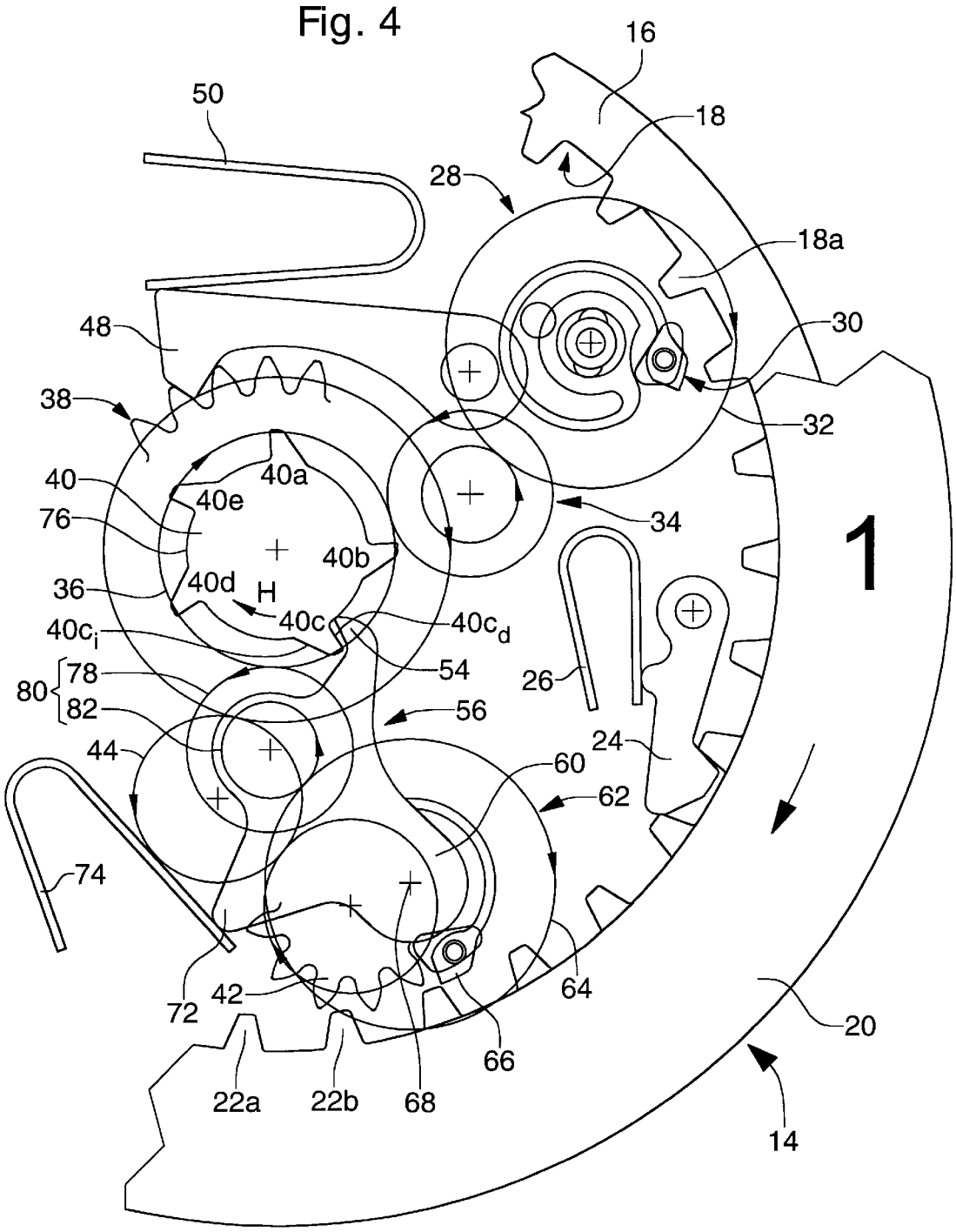

If the dial is now removed from the watch and only the elements useful for implementing the invention are retained, one ends up with the plane views of FIGS. 2, 3 and 4 which show the annual calendar mechanism of the invention at three different moments during the passage from a month of less than thirty one days to the following month, in the example illustrated during the passage from the 30th September to 1st October.

Figure 8:
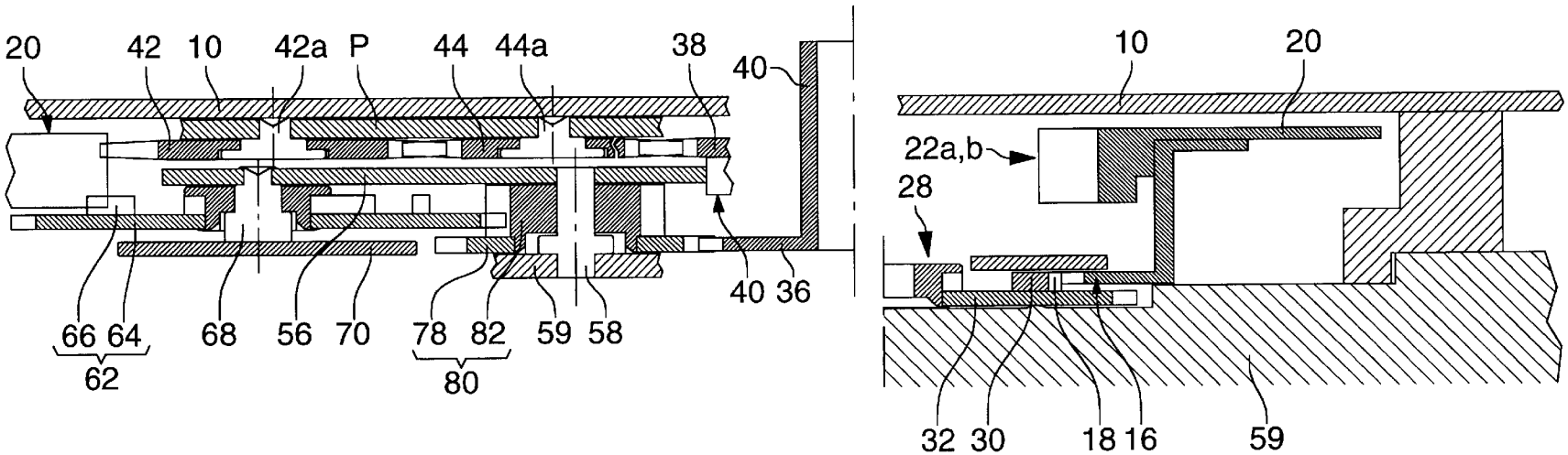
FIG. 8 is a cross-section along the line VIII—VIII of FIG. 2.

Examination of FIG. 2 and the cross-section of FIG. 8 will enable the operation of the annual calendar mechanism according to the invention to be understood. This mechanism includes a date-disc 14 formed of a lower annular disc 16 carrying a first inner toothing 18 and an upper annular toothing 20 carrying a second inner toothing 22. First toothing 18 includes thirty one teeth 18*a* whereas second toothing 22 includes two teeth 22*a* and 22*b*. The upper face of annular disc 20 carries thirty one numbers each corresponding to an indication of a day of the month. These numbers appear successively through window 8 shown in FIG. 1. Toothings 18 and 22 consequently extend in two different planes, toothing 18 extending below toothing 22.

FIGS. 2 to 4 also show that a jumper 24 returned by a spring 26 is applied against toothing 18 of disc 16 to position angularly date-disc 14 when the latter is not being activated, this allowing perfect indexing of date-disc 14 opposite window 8.

A date drive wheel and pinion designated generally by the reference 28 is fitted with a finger 30 capable of driving date-disc 14 through one step once a day via its inner toothing 18*a*. In the particular case shown in FIG. 2, finger 30 has just come into contact with a tooth 18*a* and will thus cause disc 14 to advance through one step from the 30th to the 31st as is shown in FIG. 3. As is seen in FIGS. 2 to 4 and also FIG. 8, drive wheel and pinion 28 includes a drive wheel 32 which is connected via an intermediate wheel and pinion 34 to the hour wheel 36 of a conventional clockwork movement (not shown here) which can be mechanical or electronic.

What has just been described, with the exception of the structure of date-disc 14, is well known in the state of the art. It is in fact the conventional driving of a date-disc, this disc being able to be reset to the date by means of a rapid correction device (not shown) meshed with toothing 1*a* using crown 12 (FIG. 1) when the latter is in a determined position. According to this conventional system, it is necessary to reset the date at the end of months having less than thirty one days, namely the months of February, April, June, September and November.

One will describe hereinafter what has been added to this mechanism to transform it into an annual calendar mechanism in the sense that, except for the end of the month of February, the date jumps from the 30th to the 1st at the end of the months of less than thirty one days.

As was already mentioned hereinbefore, date-disc 14 according to the invention differs from a conventional date-disc in that it includes additional toothing 22 fitted with two juxtaposed teeth 22*a* and 22*b* separated from each other by one thirty first of a revolution. It will also be noted that teeth 22*a* and 22*b* can be superposed onto two successive teeth 18*a* of lower annular disc 16.

Toothing 22 and more particularly tooth 22*a* drives, once a month, a wheel 38 which carries a month-cam 40, via a return wheel 42 and an intermediate wheel 44. Wheel 38 pivots freely on canon 46 of hour wheel 36 and is positioned by a jumper 48 returned by a spring 50 to position angularly month cam 40 when it is not being activated. Return wheel 42 and intermediate wheel 44 are pivoted respectively about shafts 42*a* and 44*a* fixed on a bridge P for example by setting (FIG. 8).

Figure 9:
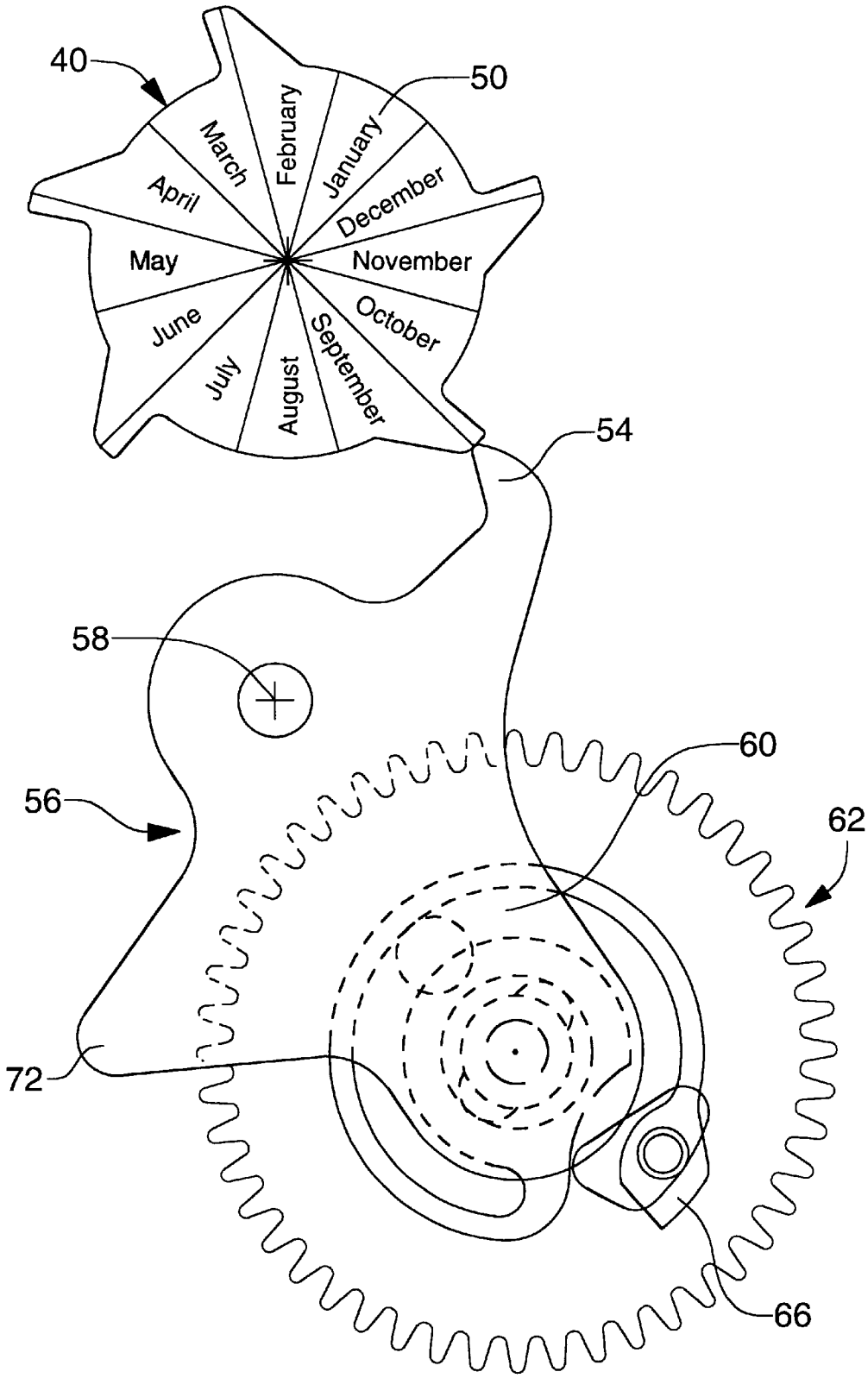
FIG. 9 is an enlarged plane view of the month-cam and the correction lever which explains the function of the month-cam with respect to the months of the year.

Month cam 40 is arranged to be activated at the end of each month by tooth 22*a* and to make one revolution in one year. For this purpose, month cam wheel 38 includes 24 teeth and return wheel 42 includes 12 teeth. Month cam 40 includes five teeth 40*a*–40*e* distributed successively at 60°, 60°, 90°, 60° and 90° on its periphery, these five teeth 40*a*–40*e* corresponding respectively to the five months of the year having less than thirty one days. Teeth 40*a*–40*e* include respectively inclined flanks $\mathbf{40}a_i$–$\mathbf{40}e_i$ and straight flanks $\mathbf{40}a_d$–$\mathbf{40}e_d$ (FIG. 9).

It will be noted that month cam 40 does not need to be coaxial with hour wheel 36 and could, in another embodiment, be situated other than at the centre of the movement.

According to a preferred embodiment, month cam 40 includes, on its face directed towards dial 10, indications 50 (FIG. 9) identifying the months of the year and appearing successively through a window 52 arranged in dial 10. In the example illustrated, window 52 is arranged at 3 o'clock and is juxtaposed to window 8. It goes without saying that this window would be arranged at any other location, for example, date window 8 at 12 o'clock and month window 52 just below.

Teeth 40*a*–40*e* are further arranged to be situated, at the end of months having less than thirty one days, on the path of a beak 54 of a lever 56 pivoted about a shaft 58 driven into plate 59 of the movement (partially shown), and thus to control the pivoting of lever 56.

Lever 56 also includes an arm 60 which carries at its end a correction drive wheel and pinion 62 including a drive wheel 64 carrying a correction finger 66. Correction wheel and pinion 62 is pivoted about a shaft 68 fixed thereto for example by setting. This shaft 68 extends in the direction of plate go. 59 from lever 56 and its free end rest on a support plate 70 fixed to plate 59 of the movement.

Lever 56 also includes a nose 72 which co-operates with a return spring 74 which forces beak 54 towards month cam 40 so that the beak is in permanent contact with cam 40, either with surface 76 of cam 40 situated back between teeth 40*a*–40*e*, or with the teeth themselves. In the example illustrated, the lever is returned by spring 74 in the anti-clockwise direction symbolised by arrow A, cam 40 itself rotating in the clockwise direction symbolised by arrow H.

Correction wheel and pinion 62 is driven from hour wheel 36 via wheel 78 of an intermediate wheel and pinion 80 whose pinion 82 meshes with drive wheel 62, the intermediate wheel being pivoted about shaft 58 between lever 56 and plate 59, the meshing being maintained when the lever pivots about this same shaft 58.

Correction drive wheel and pinion 62 is arranged, like date drive wheel and pinion 28, to make one revolution in 24 hours. On the other hand, during its rotation, correction finger 66 is capable of co-operating with tooth 22*b* at the end of months of less than thirty one days to drive date-disc 14 through an additional step at the end of said months to cause the date to pass from the 30th to 31st when lever 56 pivots following the passage of beak 54 across a tooth 40*a*–40*e* of month cam 40.

As the different elements forming the invention have been described hereinbefore, the operation of the annual calendar mechanism now needs to be explained. There can be two cases according to whether it is a month of less than thirty one days or a month of thirty one days. The passage from the 30th to the first day of the following month in the case of a month of thirty days is illustrated in FIGS. 2, 3 and 4.

FIG. 2 shows the mechanism as it is on the 30th September (month of thirty days) at 21 hours. At this moment, the date visible through window 8 is the 30th and the month indication visible through window 52 is September. Drive finger 30 is in contact with a tooth 18*a* of annular disc 16 and is ready to drive disc 14 through one step to cause it to pass from 30 to 31. Beak 54 is situated at the base of tooth 40*c*, on the side of its inclined flank, and neither wheel 42 nor correction drive finger 66 are yet engaged in toothing 22.

FIG. 3 shows the same mechanism on 30th September at midnight. Drive finger 30 has driven disc 14 through one step, in the clockwise direction, via tooth 18, and date disc 14 then displays the date 31st through window 5. During the movement of disc 14 tooth 22*a* has meshed with wheel 42 and has caused cam 40 to advance by 1/24th of a revolution in the direction of arrow H so that beak 54 of lever 56 has slid over flank $\mathbf{40}c_i$ of tooth 40*c* to the top thereof. Simultaneously, lever 56 has pivoted in the clockwise direction and correction drive finger 66 has pushed tooth 22*b* to begin to drive disc 14 through an additional step. Toothing 22 which was driving via tooth 22*a* becomes driven by its tooth 22*b* by the action of finger 66, which drives date-disc 14 through one correction step.

FIG. 4 shows the same mechanism at 02.30 hours on the 1st October. Date-disc 14 has been driven through one step by correction finger 66 and now displays the first of October. Beak 54 has passed the top of tooth 40*c* and, by the effect of spring 74, has slide along straight flank $\mathbf{40}c_d$ of tooth 40*d* to release correction finger 66 from the trajectory of toothing 22 until the next month of thirty days. Disc 14 displays at the end of its travel the FIG. 1. Once this phase is finished, correction finger 66 is completely released from teeth 22*a* and 22*b* and date-disc 14 can continue its rotation day after day.

Figure 5:
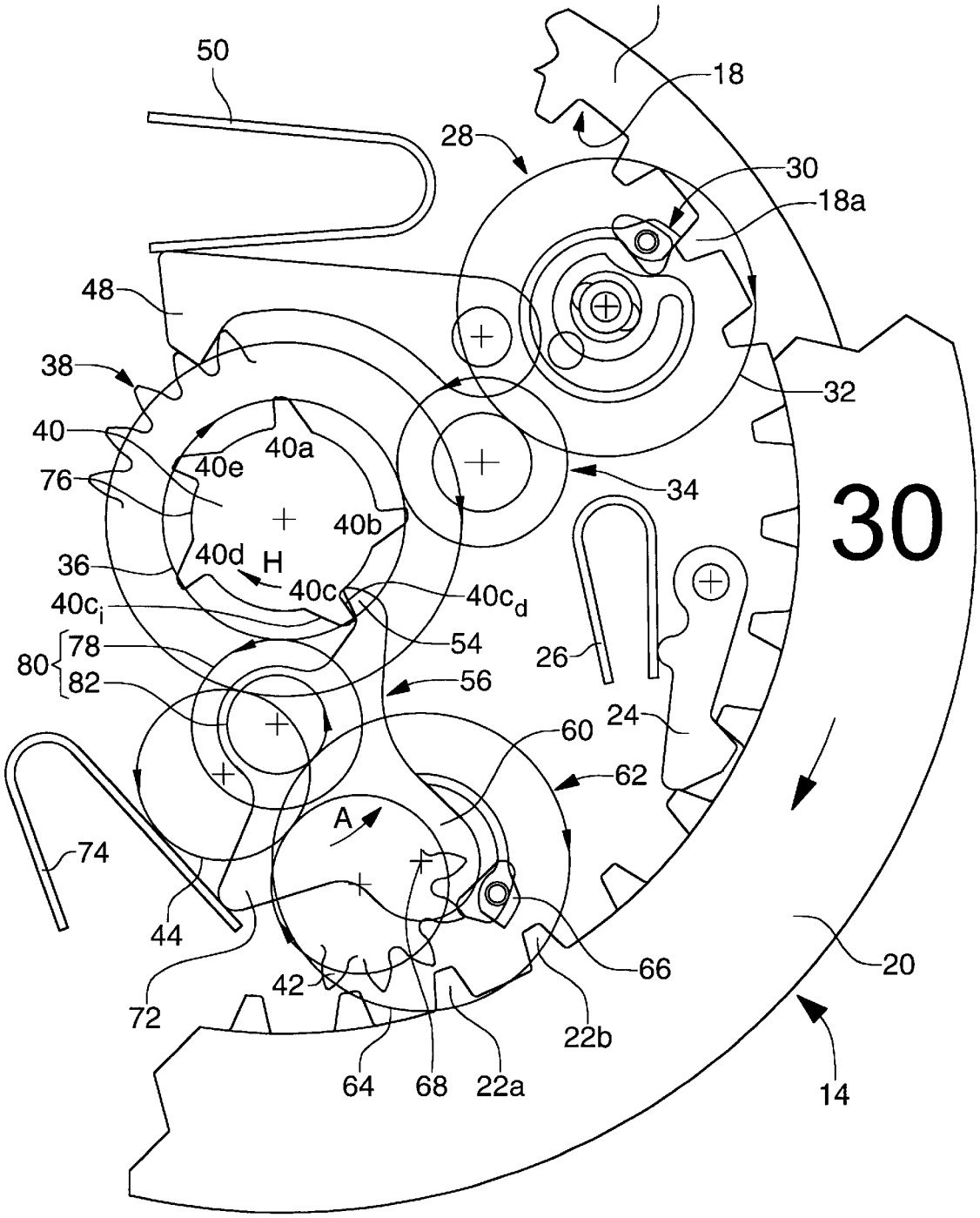
FIG. 5 is a plane view of the annual calendar mechanism fitted to the watch of FIG. 1, this Figure illustrating the position of the gear trains on the 30th of a month of thirty one days at 21 hours.
Figure 6:
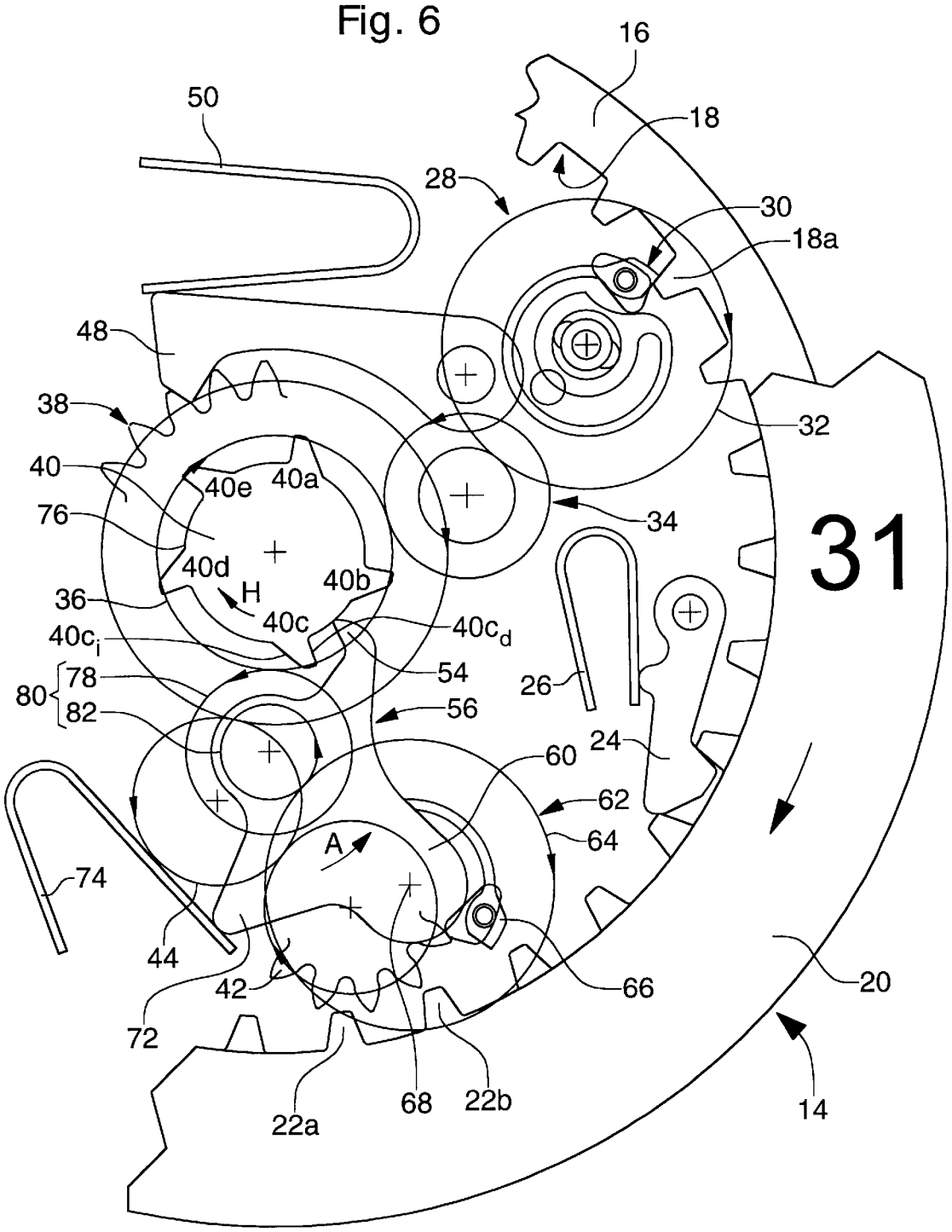
FIGS. 6 and 7 are similar views to those of FIG. 5, the position of the gear trains being respectively shown on the 31st of the same month at 21 hours and on the 1st of the following month at 21 hours.
Figure 7:
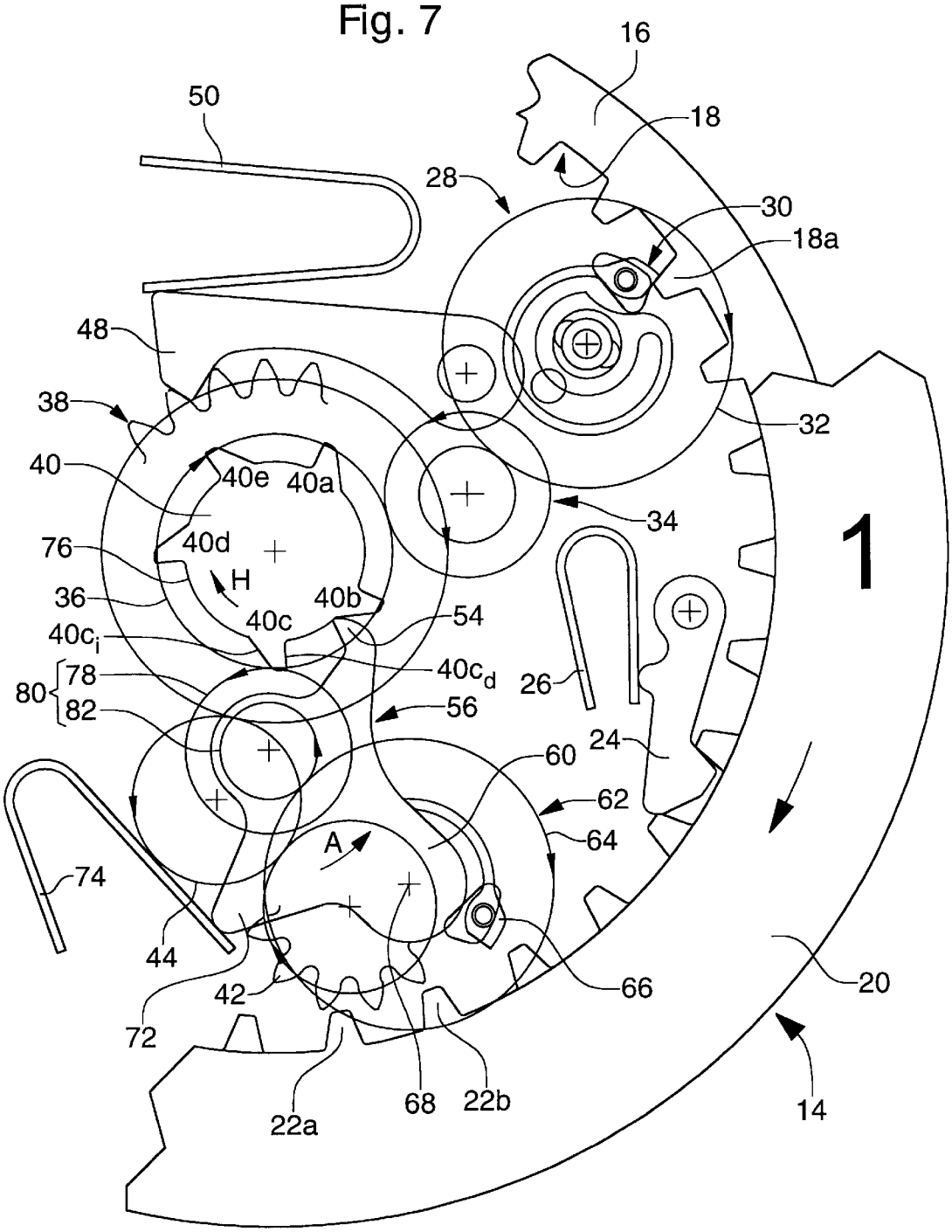

The passage from the 30th to the first day of the following month in the case of a month of thirty one days is illustrated in FIGS. 5, 6 and 7.

FIG. 5 shows the mechanism as it is on the 30th August (month of thirty one days) at 2100 hours. At this moment, the date visible through window 8 is 30 and the month indication visible through window 52 is August. Drive finger 30 is in contact with a tooth 18*a* of annular disc 16 and is ready to drive disc 14 to cause it to pass from 30 to 31. Beak 54 is situated at the base of tooth 40*c* on the side of its straight flank and neither wheel 42 nor correction drive finger 66 are yet engaged in toothing 22.

FIG. 6 shows the same mechanism as it is on 31st August at 2100 hours. In this configuration, the passage from 30th to 31st has occurred and drive finger 30 is again situated in the same position as that described with reference to FIG. 5, but this time in order to cause disc 14 to pass from 31st to 1st. During the passage from 30th to 31st, disc 14 has advanced through one step and tooth 22*a* has driven wheel 42 and thus caused month cam 40 to advance by 1/24th of a revolution. Beak 54 then rests on surface 76 of cam 40 at a substantially equal distance from teeth 40*c* and 40*d* thereof. Correction finger 66 remains released from toothing 22.

FIG. 7 shows the same mechanism as it is on 1st September at 21.00 hours. In this configuration, the passage from 31st to 1st has occurred and drive finger 30 is again situated in the same position as that described with reference to FIGS. 5 and 6, but this time in order to cause disc 14 to pass from the 1st to the 2nd. During the passage from 31st to 1st, disc 14 has advanced through one step, tooth 22*b* has driven wheel 42 and has thus caused month cam 40 to advance by 1/24th of a revolution. Beak 54 then rests on surface 76 at the base of inclined flank $\mathbf{40}d_i$ of cam 40. Correction finger 66 has remained released from toothing 22 during the entire change of month. Between the 30th and the 1st of the month of thirty one days, beak 54 has only moved over surface 76 between two teeth of cam 40 and lever 56 has thus not been activated.

It goes without saying that the mechanism which has just been described can undergo modifications without departing from the scope of the invention. By way of example, teeth 40*a*–40*e* could be replaced by hollows, it would then be necessary to reverse the pivoting point of the lever.

What is claimed is:

1. An annual calendar mechanism for a timepiece including a date-disc provided with a first inner toothing including thirty one teeth and on which are marked thirty one figures each corresponding to an indication of a day of the month, said indications appearing successively through a window arranged in a dial, and a date drive wheel and pinion, said wheel and pinion including a finger capable of driving said date-disc through one step once a day via one of the teeth of the inner toothing to control the date display, wherein the date-disc includes a second inner toothing provided for driving, via a gear train, at the end of each month a month-cam carrying at least five teeth or hollows corresponding to the months of less than thirty one days, each of these teeth being arranged to be situated, at the end of the months of less than thirty one days, on the path of the beak of a lever and wherein said lever carries a correction drive wheel and pinion fitted with a correction finger capable of co-operating with the first or second toothing at the end of the aforecited months to drive the date-disc through one additional step at the end of said months when the lever has pivoted following the passage of its beak over a tooth of the month-cam.

2. A calendar mechanism according to claim 1, wherein the second toothing includes two teeth co-operating respectively with said gear train and the correction finger attached to the correction drive wheel and pinion.

3. A calendar mechanism according to claim 2, wherein the two teeth are spaced from each other by one thirty first of a revolution.

4. A calendar mechanism according to claim 1, wherein the correction drive wheel and pinion is driven from the hour wheel via the intermediary of an intermediate wheel and pinion.

5. A calendar mechanism according to claim 4, wherein the correction drive wheel and pinion is driven to make one revolution per twenty four hours.

6. A calendar mechanism according to claim 1, including a spring which returns the lever beak towards the month cam.

7. A calendar mechanism according to claim 1, wherein the teeth of the month cam include an inclined flank and a straight flank.

8. A calendar mechanism according to claim 7, wherein the correction finger meshes on the first or second toothing when said beak slides over said inclined flank of the teeth of the month cam and is released from said toothing when said beak, returned by the lever return spring, slides along the straight flank of said teeth.

9. A calendar mechanism according to claim 1, wherein the first and second toothings of the date-disc extend respectively in different planes.

10. A calendar mechanism according to claim 9, wherein the first toothing extends below the second toothing.

11. A calendar mechanism according to claim 1, wherein the date-disc includes a lower annular disc carrying the first toothing and supporting an upper annular disc carrying the second toothing, the upper face of said upper annular disc in turn carrying the indications of the days of the month.

12. A calendar mechanism according to claim 1, wherein a jumper is arranged between two successive teeth of the first toothing of the date-disc.

13. A calendar mechanism according to claim 1, wherein the month cam includes five teeth distributed successively at 60°, 60°, 90°, 60° and 90° and is driven to make one complete revolution per year.

14. A calendar mechanism according to claim 5, wherein the indications identifying the months of the year are marked on the month cam, these indications appearing through a window arranged in the dial.

* * * * *